United States Patent [19]

Cardellini

[11] 4,349,289

[45] Sep. 14, 1982

[54] LOOSE LEAF BINDER

[76] Inventor: Vincenzo E. Cardellini, Rua Manuel Maria Tourinho, 673, 01236 Sao Paulo, SP, Brazil

[21] Appl. No.: 156,099

[22] Filed: Jun. 3, 1980

Related U.S. Application Data

[63] Continuation-in-part of Ser. No. 35,080, May 1, 1979, abandoned, which is a continuation-in-part of Ser. No. 21,682, Mar. 19, 1979, abandoned, which is a continuation of Ser. No. 895,440, Apr. 11, 1978, abandoned.

[30] Foreign Application Priority Data

Apr. 19, 1977 [BR] Brazil ..... 7702458[U]
May 2, 1978 [BR] Brazil ..... 7802756[U]

[51] Int. Cl.[3] ..... B42F 3/04; B42F 13/18

[52] U.S. Cl. ..... 402/30; 402/34; 402/41

[58] Field of Search ..... 402/19, 20, 21, 22, 402/30, 34, 35, 36, 40, 41, 44, 45, 55, 56

[56] References Cited

U.S. PATENT DOCUMENTS

| | | | |
|---|---|---|---|
| 2,314,204 | 3/1943 | Fontecillo | 402/20 |
| 2,437,360 | 3/1948 | Purvis | 402/55 |
| 2,548,618 | 4/1951 | Purvis | 402/55 |
| 2,598,044 | 5/1952 | Emmer | 402/55 |
| 2,715,906 | 8/1955 | Lucchese | 402/20 |
| 3,003,503 | 10/1961 | Dennis | 402/30 |
| 3,162,198 | 12/1964 | Dennis | 402/30 |

*Primary Examiner*—Paul A. Bell
*Attorney, Agent, or Firm*—Cushman, Darby & Cushman

[57] ABSTRACT

An arrangement is provided for retaining loose sheets of paper. A pair of sheet retaining components, each having a plurality of half loops, are hingedly held together by wire clips. An actuator is interposed between the sheet retaining components. The actuator is provided with inclined slots which, when the actuator is displaced, engage and move the clips causing one sheet retaining component to move with respect to the other to unlock the engaged ends of the respective half loops. Once unlocked, the sheet retaining components can be hinged apart to permit removal and/or addition of loose leaf paper.

6 Claims, 12 Drawing Figures

LOOSE LEAF BINDER

This application is a continuation-in-part of application Ser. No. 035,080, filed May 1, 1979, now abandoned; and a continuation-in-part of application Ser. No. 021,682, filed Mar. 19, 1979, now abandoned, which is a continuation of application Ser. No. 895,440, filed Apr. 11, 1978, now abandoned.

BACKGROUND OF THE INVENTION

Conventional loose leaf binders come in a variety of forms. Each suffers disadvantages from an economic and/or functional point of view. Attempts to produce inexpensive binders from materials which are not costly, e.g., plastics, typically have resulted in products which do not securely retain sheets of paper or which do not readily permit new sheets to be added to the retainer or removed therefrom.

The present invention relates to an improved loose leaf binder which is relatively inexpensive, provides secure retention of papers, and permits sheets of paper to be easily added to or withdrawn from the binder.

SUMMARY OF THE INVENTION

The present invention includes a pair of sheet retaining components each comprising an elongated strip and a plurality of half loops secured thereto. The strips are hinged together by wire clips. An actuator is interposed between the strips. The actuator includes a plurality of inclined slots arranged such that when the actuator is moved relative to the strips, the clips are received within the slots. This results in one retaining component being displaced with respect to the other whereby interlocking ends of the half loops on the respective strips are separated allowing the strips to be parted.

DETAILED DESCRIPTION OF THE INVENTION

This invention will be described in greater detail with respect to the accompanying drawings which illustrate two embodiments of the present invention, wherein.

Figure 1:
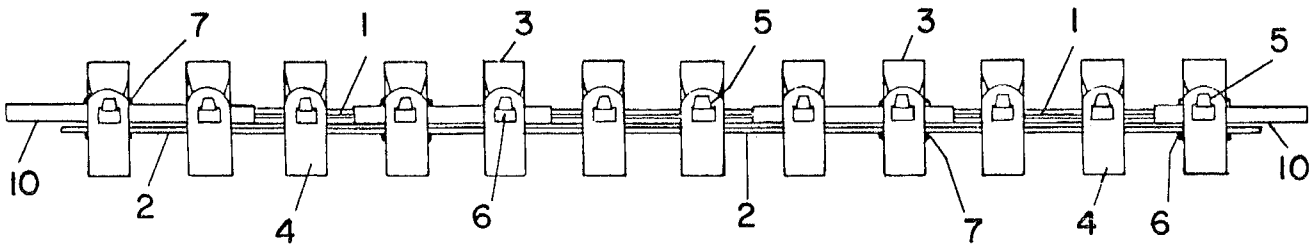
FIG. 1 is an elevational view of a first embodiment of the invention illustrating the arrangement of the components thereof when the retainer is in a fully closed position.

Referring now to the drawings, disclosed in FIGS. 1–4 are a pair of sheet retaining components, clips for interconnecting these components and an actuator component for selectively displacing the sheet retaining components from a locked mating relationship to an unlocked and separated one. More particularly, a first sheet retaining component comprises an elongated strip 1 having integrally associated therewith at spaced locations along one of its edges a plurality of half loops 3 terminating in partially turned back ends 5. A second sheet retaining component comprises an elongated strip 2 which also has associated therewith, at spaced locations corresponding to the spacings along strip 1, a plurality of half loops 4 having slots 6 adjacent their free ends. Slots 6 are dimensioned so as to be able to receive the ends 5 of loops 3.

Adjacent the intersection of the edges of the end half loops 3 and strip 1, and at corresponding locations at selected loop-strip intersections intermediate the end half loops, strip 1 is provided with parallel pairs of slots 8. These slots extend transversely of the length of strip 1, and each pair of slots receives the parallel arms of a wire clip 7 which is most clearly illustrated in FIG. 6(A). The parallel arms of the clip are joined by a web, and the free ends of the arms are bent towards one another whereby the clip is planar with only the space between free ends of the arms interrupting a completely rectangular configuration. With the webs of the clips 7 being positioned between half-loops 3 and strip 1, and the free ends of the clips passing beneath the lower edge of strip 2 and being located between half-loops 4 and strip 2, the pair of sheet retaining components are held together in hinged relationship.

As is apparent from FIG. 1, the half-loops 3 and 4 are arranged on their respective strips 1 and 2 such that when the strips are in abutting relationship, complete loops are formed for retaining sheets of paper. These loops are locked against inadvertent opening by the fact that ends 5 of loops 3 are received within slots 6 of loops 4. However, when the loops are unlocked in a manner hereinafter to be described, the sheet retaining components may be displaced 180° from one another due to their hinged connection. The displacement is limited only by the engagement of the outside surfaces of the half-loops 3 and 4.

Figure 4:
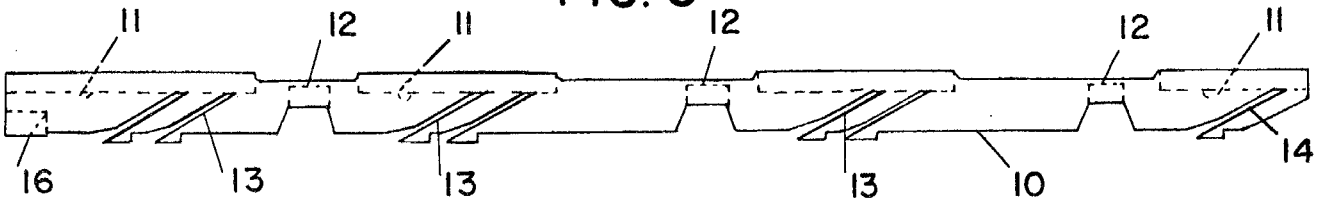
FIG. 4 is an elevational view of the portion of the FIG. 1 embodiment omitted in FIG. 3, said portion comprising the actuator component for unlocking and separating the sheet retaining components.
Figure 5:
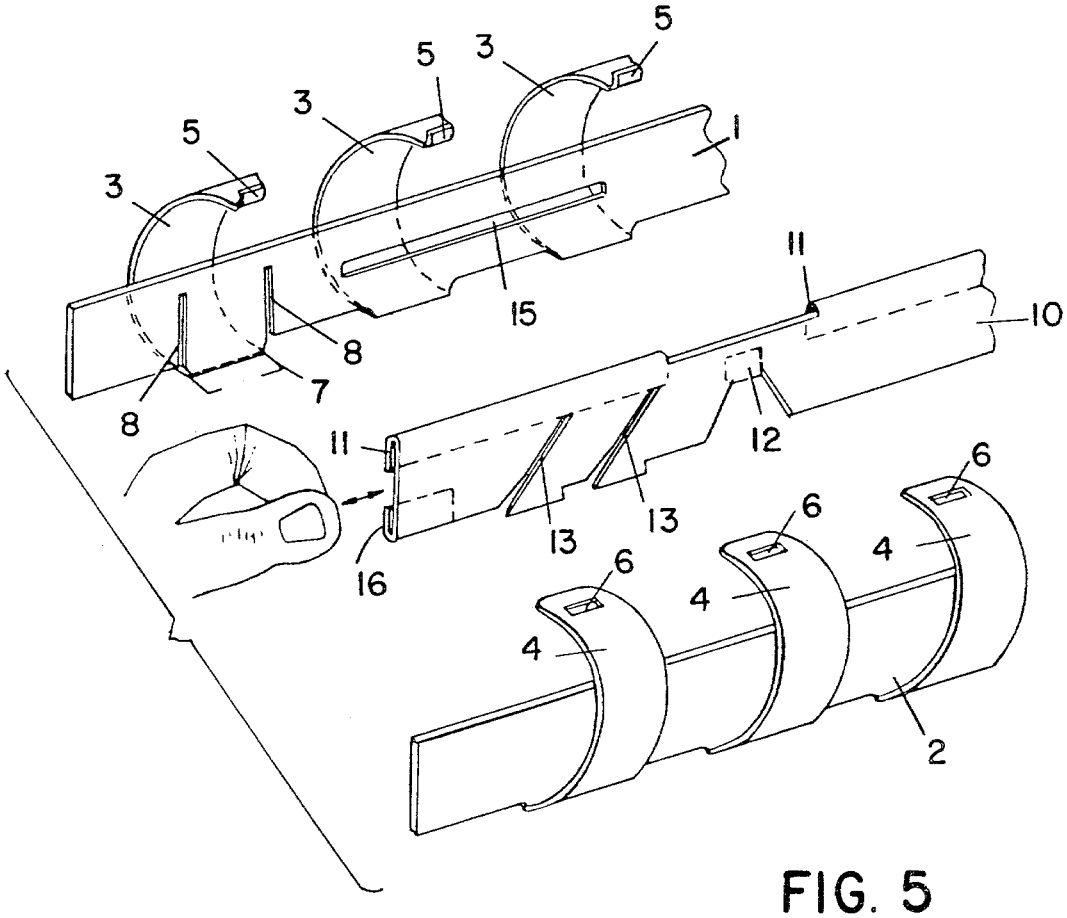
FIG. 5 is an exploded and enlarged perspective view of a portion of the embodiment shown in FIG. 1.

Referring to FIGS. 4 and 5, the actuator component for unlocking and separating the sheet retaining components will be described. The actuator component comprises an elongated strip 10 having a length slightly greater than that of strips 1 and 2. At locations along one edge of strip 10, the strip is provided with tabs 11 which are folded over in a manner so as to receive an edge of strip 1 as hereinafter will be described. Along the opposite edge of strip 10 at locations between tabs 11, the strip 10 is notched in such a manner that tabs 12 at the bottoms of the notches can be folded over so as to project towards that edge of strip 10 which carries tabs 11. Underlying each tab 11 (except for the one at the righthand end of the strip in FIG. 4) the strip 10 is provided with a pair of inclined parallel slots 13. The slots of each pair are separated by a distance corresponding to the spacing between the spaced parallel arms of clip 7 and by the distance separating the slots of each pair 8 formed in strip 1. A single inclined slot 14, which is parallel to slots 13, is provided adjacent the aforesaid end of strip 10.

As can be appreciated from FIG. 5 et seq., the strip 1 is slidably joined to the actuator component. This is accomplished by the folded over tabs 11 receiving an edge of strip 1 and tabs 12 passing through elongated slots 15 in strip 1 and extending upwardly alongside the surface of strip 1 opposite that surface adjacent to strip 10. To further serve to retain strip 1 in operative relationship with the actuator component, strip 10 is provided with an additional folded over tab 16 adjacent an end of the strip.

Figure 2:
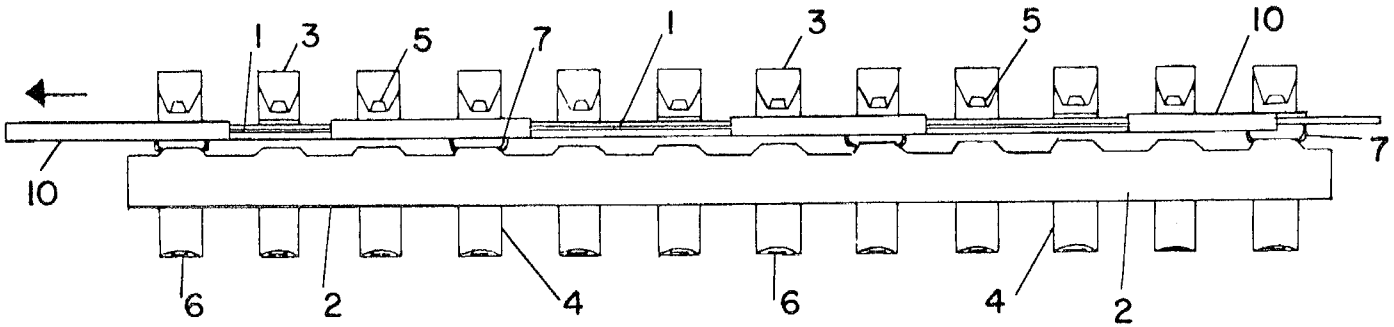
FIG. 2 is an elevational view of the embodiment shown in FIG. 1 illustrating the arrangement of the components thereof when the retainer is open with the sheet retaining components displaced by 90° with respect to one another.
Figure 3:
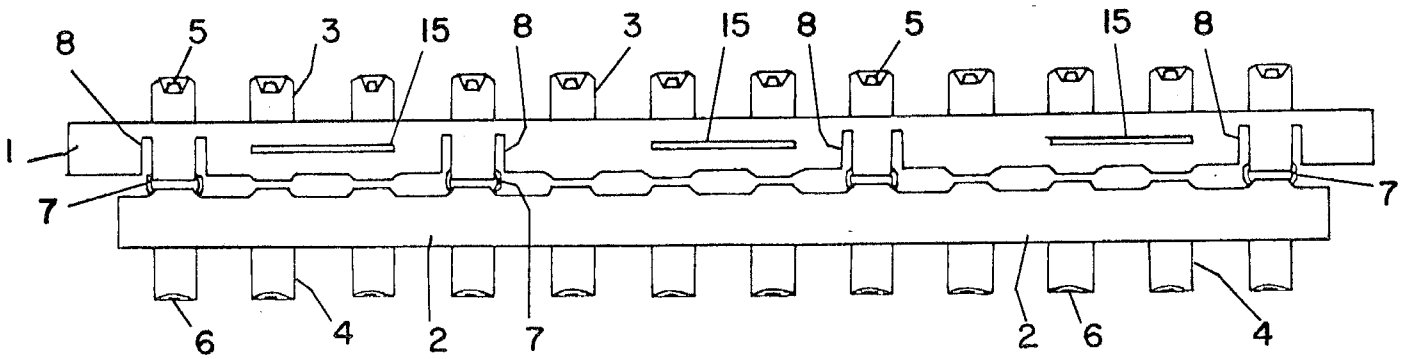
FIG. 3 is an elevational view of a portion of the embodiment shown in FIG. 1 illustrating the arrangement of the sheet retaining components thereof when the retainer is open with the retaining components displaced by 180° with respect to one another.
Figure 6:
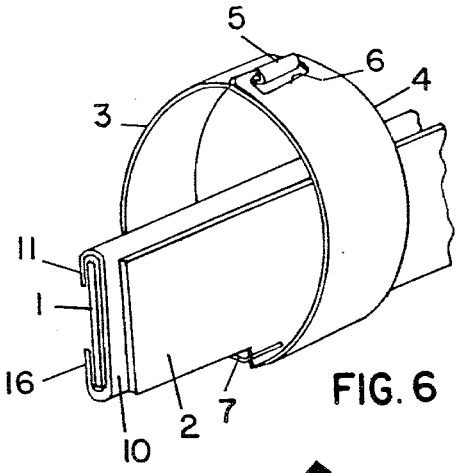
FIG. 6 is an enlarged perspective view of a portion of the FIG. 1 embodiment, the sheet retaining components being in the closed position.
Figure 6A:
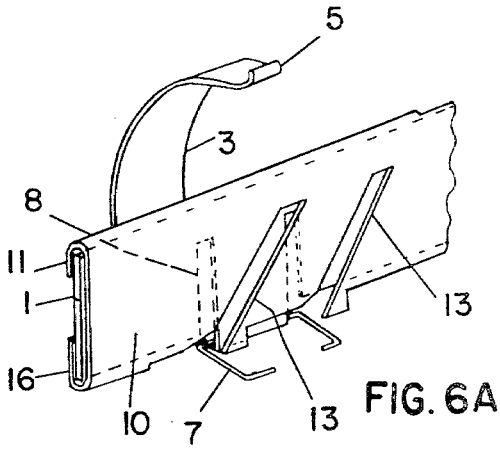
FIG. 6A is an enlarged perspective view corresponding to FIG. 6 but with one of the sheet retaining components omitted.
Figure 7:
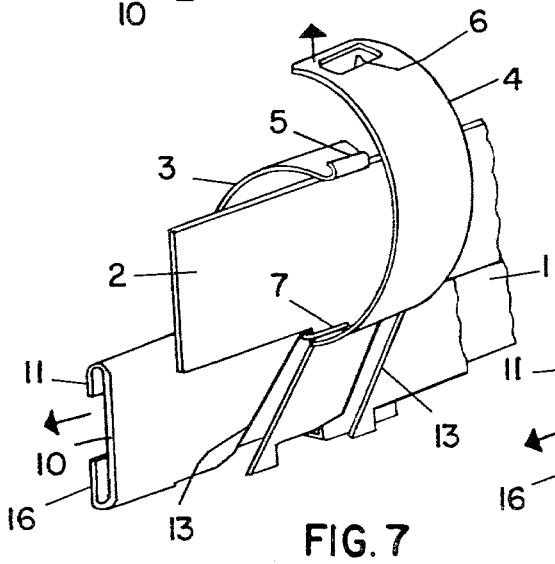
FIG. 7 is an enlarged perspective view of a portion of the FIG. 1 embodiment, the sheet retaining components being in separated relationship following their being unlocked.
Figure 7A:
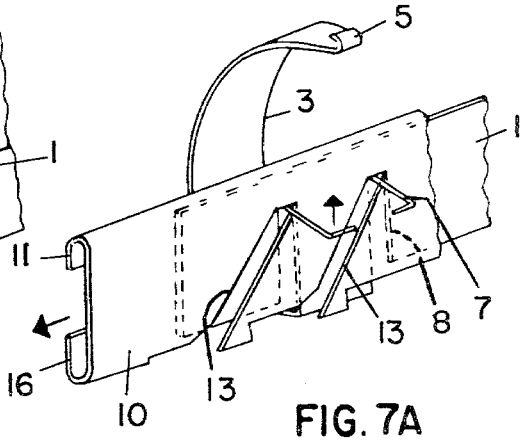
FIG. 7A is an enlarged perspective view corresponding to FIG. 7 but with one of the sheet retaining components omitted.
Figure 8:
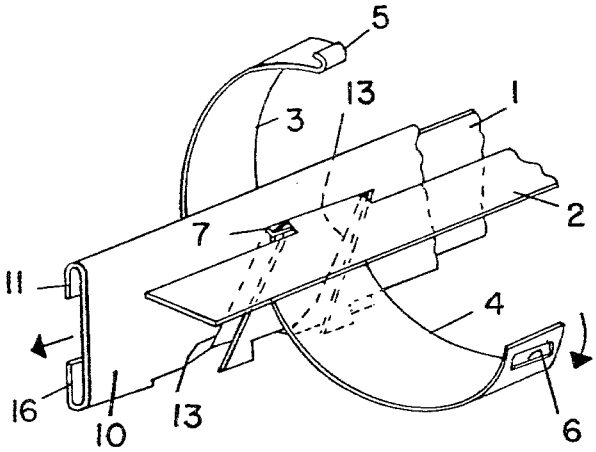
FIG. 8 is an enlarged perspective view of a portion of the FIG. 1 embodiment, the sheet retaining components being in separated relationship and displaced by 90° with respect to one another.

With the actuator component joined to strip 1 as just described, and with strips 1 and 2 hinged together by clips 7, the parallel arms of each clip (except for one arm associated with the clip at the righthand end of the retainer in FIGS. 1–3) project through corresponding slots 13 and 14 in strip 10. Consequently, with the sheet retainer closed, as shown in FIGS. 1 and 6, upon displacement of the actuator with respect to strip 1 in the direction shown by the arrowheads in FIGS. 2, 7, 7A and 8, the parallel arms of clips 7 rise along their associated slots 8, 13 and 14 causing strip 2 to be elevated (as shown in FIG. 7) thereby disengaging the ends 5 of loops 3 from the slots 6 in loops 4. The transverse slots 8 in strip 1 prevent the interconnected strips 1 and 2 from being displaced in the direction of movement of the actuator component. With the loop ends separated, they may be pivotally displaced with respect to one another (as in FIG. 8) due to the hinging action of clips 7 with respect to strips 1 and 2. This permits sheets to be removed from loops 3 and/or 4, or added thereto. To close the retainer again, it is enough to return loops 3 and 4 to a position as shown in FIG. 7, then returning the actuator to a position as shown in FIG. 6A, so as to cause the ends 5 to again be received within slots 6 thereby locking the sheet retaining components against relative rotation with respect to one another.

Figure 9:
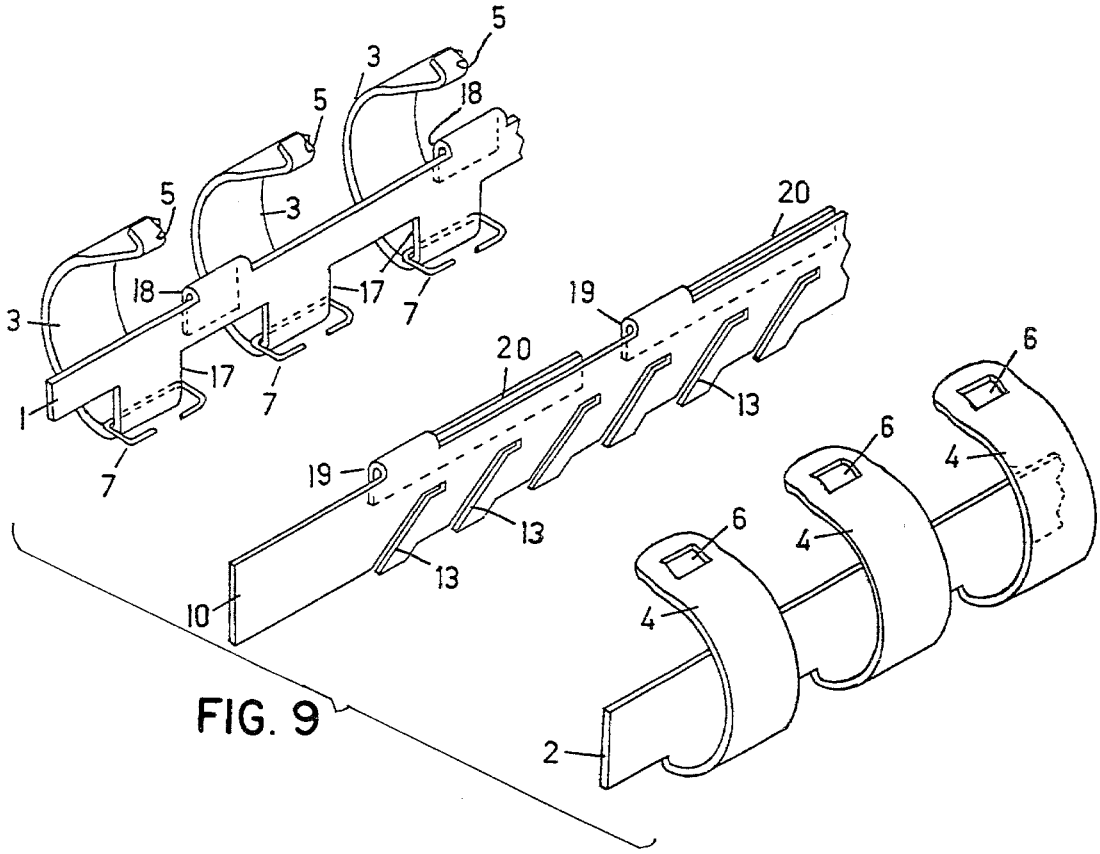
FIG. 9 is an exploded and enlarged perspective view of a portion of a second embodiment of the invention.
Figure 10:
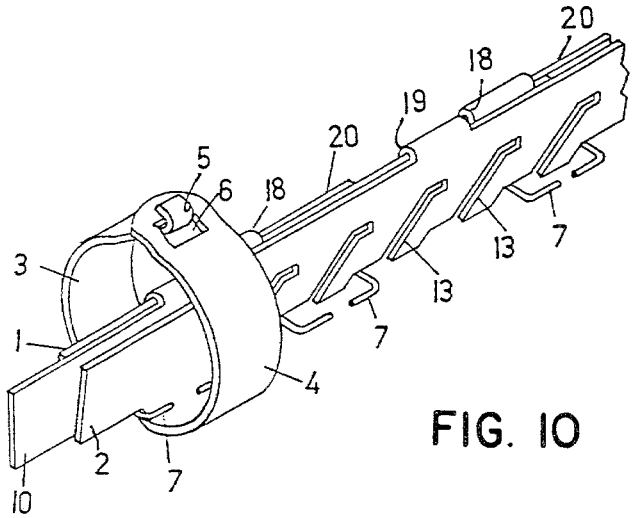
FIG. 10 is an enlarged perspective view of the embodiment of the invention shown in FIG. 9, the retainer being in a fully closed position and elements shown in FIG. 9 being omitted for convenience of illustration.

Referring now to FIGS. 9 and 10, a second embodiment of the invention will be illustrated. For convenience, elements generally corresponding to those included in the embodiment of FIGS. 1–8 are identified by like numbers in FIGS. 9 and 10.

In the arrangement of FIG. 9, the half loops 3 are secured to projections 17 extending from strip 1 at spaced locations along one edge thereof. The half loops 3 receive the webs of clips 7 in the same manner as described with respect to the first embodiment of the invention. The edge of strip 1 opposite that from which elements 17 project are provided with folded over tabs 18.

The strip 2 and half loops 4 of the second embodiment of the invention are similar to the first embodiment which has been described. Thus, the strips 1 and 2 and their associated half loops 3 and 4 are hinged together in substantially the same manner as the embodiment of the invention first described.

The actuator component includes an elongaged strip 10 having parallel inclined slots 13 arranged in pairs to receive the arms of respective clips 7 in a manner similar to that previously described. However, the inner ends of the slots 13 are provided with segments which extend longitudinally of strip 10. This feature assists in maintaining the retainer open when the actuator is displaced to cause separation of the sheet retaining components.

Along the nonslotted edge of strip 10 spaced folded over tabs 19 are provided. Each such tab supports a strip 20 in spaced parallel relationship with respect to strip 10. The spacing between each strip 20 and strip 10 is such as to receive the folded over tabs 18 provided on strip 1. Consequently, strip 1 and the actuator are slidably joined together in operative relationship.

The second embodiment of the invention operates in a manner substantially the same as that described in detail with respect to FIGS. 1–8. Therefore, it is unnecessary to repeat the description except to note that since the combined width of strip 1 and length of projections 17 is substantially the same as the width of strip 2, and inasmuch as the width of projections 17 is slightly less than the spacing between the arms of clips 7, the projections serve to guide the clips as they move transversely to strip 1 as the actuator is displaced. This action corresponds to that produced by slots 8 in the embodiment of FIGS. 1–8.

With the arrangements just described, sheets of paper are securely retained until the actuator is displaced to unlock and open the half loops permitting sheets to be added or removed from the retainer. When this occurs, the actuator can again be displaced in an opposite sense to permit relocking of the half loops.

What is claimed is:

1. A loose leaf binder comprising:

first and second elongated strips each having a plurality of half loops joined to an edge thereof at corresponding spaced locations along said edge;

means provided at the ends of said half loops to permit a half loop associated with one strip to interlock with a half loop associated with the other strip to form a full loop when the strips are positioned in juxtaposition;

a plurality of clip means hingedly interconnecting said strips, each of said clip means being located proximate said edges of the strips;

means provided on one of said strips for permitting movement of said clip means transversely of said strip;

an actuator slidably joined to one of said strips, said actuator having a plurality of parallel inclined slots adapted to receive said clip means whereby when said actuator is moved in a direction longitudinally of said elongated strips, movement of the clip means within said slots displaces the clip means transversely of said one strip to engage an edge of the other strip thereby moving said other strip to release its half loops from interlocking relationship with the half loops of said one strip.

2. A loose leaf binder as set forth in claim 1, wherein:

said interlocking means comprises an aperture in one half loop and a bent end portion of another half loop which is received within said aperture.

3. A loose leaf binder as set forth in claim 1, wherein:

each of said clip means is substantially rectangular in shape, parallel portions of said clip means being received at the intersections of said half loops and said strips.

4. A loose leaf binder as set forth in claim 3, wherein: said means for permitting movement of the clip means transversely of said one strip includes a pair of parallel slots in said strip, said pair of slots being located on opposite sides of the intersections of the half loops with said one strip and extending transversely to the length of said one strip.

5. A loose leaf binder as set forth in claim 1, wherein: each of said clip means is substantially rectangular in shape, parallel portions of a group of clip means being received at the intersections of said half loops and projections extending from the edges of said strips and parallel portions of the remainder of said clip means being received by additional projections extending from the edges of said strips.

6. A loose leaf binder as set forth in claim 5, wherein: said projections are dimensioned with respect to the width of said one strip to permit movement of the clip means transversely of said one strip.

* * * * *